United States Patent [19]

Galesloot

[11] 4,082,683

[45] Apr. 4, 1978

[54] CLEANING OF HARD SURFACES

[75] Inventor: Wilhelmus Gerardus Galesloot, Haaften, Netherlands

[73] Assignee: Lever Brothers Company, New York, N.Y.

[21] Appl. No.: 722,254

[22] Filed: Sep. 10, 1976

[30] Foreign Application Priority Data

Sep. 19, 1975 United Kingdom ..... 38550/75

[51] Int. Cl.[2] ..... C11D 7/54

[52] U.S. Cl. ..... 252/105; 252/81; 252/178; 252/188

[58] Field of Search ..... 252/105, 188, 81, 178

[56] References Cited

U.S. PATENT DOCUMENTS

| | | | |
|---|---|---|---|
| 3,183,191 | 5/1965 | Hach | 252/105 |
| 3,732,171 | 5/1973 | Kuhajek et al. | 252/105 |
| 3,773,679 | 11/1973 | Kise et al. | 252/188 |

FOREIGN PATENT DOCUMENTS

| | | | |
|---|---|---|---|
| 644,507 | 7/1962 | Canada | 252/105 |
| 951,290 | 5/1962 | United Kingdom | 252/105 |

*Primary Examiner*—Mayer Weinblatt

*Attorney, Agent, or Firm*—James J. Farrell; Kenneth F. Dusyn; Melvin H. Kurtz

[57] ABSTRACT

An improved dithionite composition suitable for preparing stock solutions comprising a dithionite, e.g., sodium dithionite, and at least 5% by weight of a water-soluble sulphite, e.g., sodium sulphite. The composition may further contain a metal-complexing agent, an activator for the dithionite, a surface-active agent and a thickening agent. The composition is applicable for the removal of metal dust soiling and metal oxide stains, particularly rust stains, from surfaces.

4 Claims, No Drawings

CLEANING OF HARD SURFACES

The invention relates to dithionite compositions and use of said compositions for cleaning surfaces. The invention is applicable for the removal of metal dust soiling and metal-oxide stains, particularly rust stains from surfaces, both in household and in industry.

Sodium dithionite ($Na_2S_2O_4$ or $Na_2S_2O_4.2H_2O$), also named sodium sulphoxylate or sodium hydro-sulphite is a known reducing agent.

Also known are the stain and rust removing properties of dithionite compositions as disclosed in British Pat. No. 951,290.

Aqueous dithionite solutions are, however, unstable; they decompose rapidly, giving malodour due to the formation of sulphur dioxide and possibly also hydrogen sulphide. It has been suggested to suppress this decomposition and the development of objectionable odours by adding weak alkaline agents, such as ammonia, triethanolamine and ammonium carbonate, or metal-complexing agents, as described in German patent application No. 1,042,165 and British Pat. No. 951,290.

Whereas the presence of such agents may indeed sufficiently reduce the development of objectionable odours from sodium dithionite, to make it practicable for use in the household and in processes where an aqueous solution, a slurry or paste of sodium dithionite after preparation is immediately applied, it does not, however, provide sufficient stabilization of dithionite solutions on storage.

Several cleaning operations, especially industrial cleaning, require the use of stock solutions of the cleaning composition. Since stock solutions are not normally used up immediately, they should not deteriorate and lose their effectiveness within the standing time, which may vary from several hours to several days.

It is an object of the present invention to provide a dithionite composition having improved stability.

It is a further object of the invention to provide a cleaning composition comprising a dithionite, having improved stability and cleaning capacity.

A particular object of the invention is to provide a substantially neutral, non-corrosive and non-toxic dithionite composition, which is active in removing iron dust soiling and which can be suitably used for cleaning the exteriors of coaches, particularly railway coaches soiled with brake block dust.

The compositions of the invention on contact with water form stable solutions and are particularly useful for preparing stock solutions.

These and other objects which will be apparent from the following description can be achieved by incorporating in the dithionite composition a water-soluble sulphite.

Accordingly, the invention provides a dithionite composition comprising a dithionite, optionally a metal-complexing agent and an activator for the dithionite, characterised in that the composition incorporates a water-soluble sulphite in a proportion of at least 5% by weight, preferably 10–75% by weight.

Though the most commonly used dithionites for stain removal are the alkali metal and zinc salts, particularly sodium dithionite, it should be appreciated that the invention is not limited thereto and any dithionite exerting a reducing effect to provide stain-removing properties can be used in the present invention. A preferred dithionite is, however, sodium dithionite.

Examples of water-soluble sulphites which can be used in the present invention are the alkali metal sulphites, including ammonium sulphite. A preferred sulphite is sodium sulphite.

The metal-complexing agents which can be used in the present invention are known in the art. They are capable of chelating or sequestering metal ions to varying degrees and include nitrilotriacetic acid and its alkali metal salts, such as sodium nitrilotriacetate (NTA); ethylene diamine tetraacetic acid and its alkali metal salts, such as tetrasodium ethylene diamine tetraacetate (EDTA); citric acid and gluconic acid and their alkali metal salts, such as sodium citrate and sodium gluconate.

Activators for dithionites are also known in the art and have been disclosed in British Pat. No. 951,290. They comprise OH—, Cl—, Br— or $NO_2$-substituted benzo- or naphthoquinones.

Any of these known activators can be used as desired in the composition of the invention.

Another class of useful activators is formed by the group of $SO_3H$— and OH-substituted anthraquinones, e.g., 1,4-dihydroxy anthraquinone and anthraquinone-2-sulphonic acid.

Accordingly the composition of the invention comprises a dithionite and a water-soluble sulphite, e.g., sodium dithionite and sodium sulphite, and optionally a complexing agent, an activator and furthermore as desired other ingredients and fillers, such as surface-active agents, perfume and sodium sulphate.

The presence of an organic surface-active agent, e.g., an anionic or a nonionic surfactant, is generally advantageous in cases where the metal dust and iron oxide soiling is combined with fatty or oily material. A preferred surface-active agent is a nonionic surfactant, e.g., $C_{12}$–$C_{18}$ alcohol condensed with 5–10 ethylene oxide groups.

A thickening agent is preferably added to achieve a somewhat thickened liquid, when preparing stock solutions of the composition. A desirable viscosity range of dithionite solutions for cleaning purposes is from about 20 cps – 100 cps, preferably from about 30 cps to about 80 cps. It has been found that within said viscosity range dithionite solutions are better manageable for use in spray-cleaning. Moreover, thickened dithionite solutions show increased stability and cleaning performance. Particularly when the solution is used for cleaning vertical surfaces by spraying, the thickened liquid adheres to the surface and does not flow down easily from the surface by gravitational forces, so increasing the reaction time.

Though quite a number of thickening agents are known in the art, the number of useful thickening agents suitable for the present system is quite limited. Suitable types of thickeners are polysaccharides and hydroxymethyl- and hydroxyethylcellulose derivatives.

In preparing the composition of the invention any of the optional ingredients may be formulated together with the basic composition comprising dithionite and sulphite, but, for the sake of convenience in handling and dosing, it may be advantageous to formulate them as a separate composition, which can be dosed at any desirable ratio with the basic dithionite composition.

A preferable composition system is that which on admixing with water provides a solution having a pH within the range of 5 to 9, more particularly from 6 to 8.

Hence, according to one aspect of the invention, a dithionite powder composition may comprise the following ingredients:

dithionite; 25 - 60 parts by weight
sulphite; 5 - 50 parts by weight
complexing agent; 0 - 30 parts by weight
activator; 0 - 5 parts by weight
thickening agent; 0 - 15 parts by weight
surface-active agent; 0 - 10 parts by weight
filler, e.g., sodium sulphate; 0 - 40 parts by weight As a further illustration the following dithionite powder compositions are within the scope of the present invention:

| | |
|---|---|
| Composition A | |
| sodium dithionite | 25 - 95% by weight |
| sodium sulphite | 5 - 75% by weight |
| Composition AB | |
| sodium dithionite | 20 - 60% by weight |
| sodium sulphite | 10 - 50% by weight |
| complexing agent | 5 - 30% by weight |
| activator | 0.3 - 5% by weight |
| thickening agent | 1 - 15% by weight |
| filler, e.g. sodium sulphate | 0 - 40% by weight |
| surface-active agent | 0 - 10% by weight |
| Composition system (A + B) | |
| (A) sodium dithionite | 25 - 95% by weight |
| sodium sulphite | 5 - 75% by weight |
| (B) complexing agent | 30 - 70% by weight |
| activator | 5 - 20% by weight |
| thickening agent | 15 - 50% by weight |
| surface-active agent | 0 - 15% by weight |
| filler, e.g. sodium sulphate | 0 - 40% by weight |

The above-described compositions of the invention are particularly active in removing metal dust soiling and rust stains, are substantially non-toxic, non-corrosive and easily dissolvable in cold water, giving stable solutions.

Adjusted to a pH value of about 5–9 the solutions do not form deposits in hard water, do not cause stress crazing of polishes and are non-corrosive to aluminum, and hence are particularly suitable for use in the cleaning of sinks and bathtubs and rust removal of metal surfaces as well as the exterior cleaning of coaches, particularly railway coaches, soiled with brake block dust.

Cleaning of and stain removal from surfaces are carried out by preparing an aqueous solution of the dithionite composition of the invention and treating the surfaces therewith. Any method, including immersion cleaning and spray-cleaning, can be applied. Preferably the pH of the solution should be maintained within the range of 6 to 8.

Hence, according to another aspect of the invention, a process for the exterior cleaning of coaches comprises subjecting the coaches to the action of an aqueous solution of a dithionite composition of the invention having a pH of 5–9.

A most convenient way of cleaning the exterior of coaches is by spraying said solution on to the coaches and, after some residence time to allow the reaction to proceed, washing off the cleaning solution from the coaches with a spray of water.

A typical cleaning solution for use in spray-cleaning will contain approximately 1–10% by weight of dithionite, preferably 3–7%, and 0.1–10%, preferably 0.5–5% of sulphite.

Depending on the type of soiling, i.e. more or less fatty soiling, the use of surface-active agent may be necessary. This surface-active agent, e.g., a nonionic surfactant, can be included as a component of the cleaning powder composition. It is, however, practicable to separate the surfactant from the main cleaning composition and mix it therewith on preparing the solution. Alternatively the washing process can be carried out in two stages, namely a first pre-wash spray with a surfactant solution, followed by a spray of the cleaning composition.

EXAMPLES I - II

5% solutions of the following experimental formulations were prepared; pH and reducing capacity were measured at intervals, the latter using potassium permangate.

| | Nominal Formulations (parts by weight) | | | | | |
|---|---|---|---|---|---|---|
| | I | II | A | B | C | D |
| Sodium dithionite | 47.0 | 47.0 | 47.0 | 47.0 | 47.0 | 47.0 |
| Sodium sulphite anh. | 18.0 | 34.5 | — | — | — | — |
| Sodium sulphate | 16.5 | — | 34.5 | — | — | — |
| 2,5-dihydroxy-p-benzoquinone | 1.5 | 1.5 | 1.5 | 1.5 | 1.5 | — |
| Sodium nitrilo-triacetate | 10.0 | 10.0 | 10.0 | 10.0 | — | 10.0 |
| pH | | | | | | |
| Initial | 8.6 | 8.4 | 8.0 | 8.6 | 6.7 | 9.4 |
| After 2 hours | 6.9 | 7.2 | 6.6 | 6.8 | 6.3 | 6.8 |
| After 48 hours | 5.8 | 6.3 | 6.0 | 5.9 | 4.0 | 4.1 |
| Reducing capacity | % | % | % | % | % | % |
| After 30 minutes* | 98 | 100 | 84 | 83 | 78 | 88 |
| After 24 hours | 60 | 61 | 47 | 47 | 53 | 43 |
| After 48 hours | 47 | 52 | 35 | 37 | 37 | 32 |

*Initial value of each solution taken as 100%.

The above reducing capacity measurement results show that compositions I and II of the invention were more stable than the compositions A–D used for comparison.

EXAMPLES III–VI

The following compositions were prepared. The percentages are by weight.

| Components (%) | III | IV | V | VI |
|---|---|---|---|---|
| sodium dithionite | 50 | 40.0 | 20.0 | 37.0 |
| sodium sulphite | 30 | 10.0 | 40.0 | 37.0 |
| citric acid | — | — | 15.0 | — |
| sodium gluconate | 20 | — | — | — |
| NTA | — | — | — | — |
| EDTA | — | 15.0 | 5.0 | — |
| sodium sulphate | — | 35.0 | 20.0 | 17.0 |
| chloranilic acid | — | — | — | 0.3 |
| hydroxyethylcellulose thickening agent | — | — | — | 7.7 |
| secondary $C_{15}$-alcohol condensed with 9 ethylene oxide groups | — | — | — | 1.0 |

The above compositions are easily dissolvable in cold water. 5% solutions of the above compositions were rated stable for at least 24 hours.

EXAMPLES VII–IX

The rate of iron removal from brake block dust of two dithionite solutions of the invention was determined. As oxalic acid is generally considered as being a very good agent for rust removal, a 5% oxalic acid solution was used for comparison.

Test Method

1. Place 2 g. of brake block dust in 400 ml. masked * tall form beaker.

* (To prevent photo-chemical reduction of ferric oxalate to insoluble ferrous oxalate when oxalic acid is being used.)

2. Place beaker in water bath at 25° C.

3. Position stirrer blades 1 cm. above bottom of beaker.
4. Switch on stirrer to 375 r.p.m. (No. 8 on control box).
5. Pour 300 ml. of test solution (previously adjusted to 25° C) into the beaker, at the same time start the stop watch.
6. At intervals of 2, 5 and 10 minutes, using an inverted 10 ml. pipette fitted with a suction bulb, quickly remove ~ 12 ml. of solution and filter quickly through a Buchner funnel fitted with Whatman No. 541 paper.
7. Swirl contents of Buchner flask and transfer 10 ml. aliquot to a 250 ml. conical flask.
8. Determine the iron content by standard method.

| Solution (% by weight) | VII | VIII | IX |
|---|---|---|---|
| sodium dithionite | 5.00 | 3.00 | 5.2 |
| sodium sulphite | 1.25 | 1.25 | 2.3 |
| 2.5 dihydroxy-p-benzoquinone | 0.10 | 0.10 | — |
| anthraquinone-2-sulphonic acid | — | — | 0.1 |
| trisodium NTA | 0.50 | 0.50 | 0.5 |
| sodium sulphate | 0.65 | — | — |
| hydroxyethylcellulose thickening agent ("Natrosol 250 HR" ex Hercules Powder Co.) | 0.35 | — | 0.3 |
| $C_{12}$–$C_{15}$ alcohol/7 ethylene oxide | — | — | 0.1 |
| water | up to 100 | up to 100 | — |
| pH initial | 6.85 | 7.1 | 7.5 |

| | % iron removed | | |
|---|---|---|---|
| Time | 2 min. | 5 min. | 10 min. |
| Solution VII | 60 | 85 | 100 |
| Solution VIII | 38 | 55 | 66 |
| Solution IX | 27 | 48 | 64 |
| 5% oxalic acid | 39 | 74 | 90 |

I claim:

1. A dithionite composition which upon admixture with water forms a solution of pH 5 to 9 consisting essentially of:

a. 20–60% by weight of a dithionite selected from the group consisting of alkali metal dithionites and zinc dithionites;
b. 10–50% by weight of a water soluble sulfite selected from the group consisting of alkali metal sulfites and ammonium sulfite;
c. 5–30% by weight of a metal-complexing agent selected from the group consisting of nitrilotriacetic acid; the alkali metal salts of nitrilotriacetic acid, ethylene diamine tetraacetic acid; the alkali metal salts of ethylene diamine tetraacetic acid; citric acid; the alkali metal salts of citric acid; gluconic acid; the alkali metal salts of gluconic acid;
d. 0.3–5% by weight of an activator for said dithionite, wherein said activator is selected from the group consisting of $OH^-$, $Cl^-$, $Br^-$ or $NO^-_2$ substituted benzoquinone; $OH^-$, $Cl^-$, $Br^-$ or $NO^-_2$ substituted naphthoquinone, and $SO_3H^-$ or $OH^-$ substituted anthraquinone;
e. 1–15% by weight of a thickening agent in an amount sufficient to result in said composition having a viscosity of about 20 to about 100 centipoises when admixed with water, said thickening agent being selected from the group consisting of derivatives of polysaccharides and hydroxyethylcellulose; and
f. optionally 0–10% by weight of an anionic or nonionic organic surface active agent, and 0–40% by weight of sodium sulfate.

2. A dithionite composition as claimed in claim 1, in which the dithionite is sodium dithionite and the water-soluble sulphite is sodium sulphite.

3. A dithionite composition as claimed in claim 1, the solution of which has a pH within the range of 6 to 8 and a viscosity of 30 cps to 80 cps.

4. A dithionite composition as claimed in claim 1, which incorporates an $SO_3H$— or OH-substituted anthraquinone.

* * * * *